US009302836B2

(12) United States Patent
Cowan et al.

(10) Patent No.: US 9,302,836 B2
(45) Date of Patent: Apr. 5, 2016

(54) EASY OPEN REAM WRAP

(75) Inventors: Amaia Cowan, Wigton (GB); Jonathan Hewitt, Wigton (GB); Leo Fröhlich, Wigton (GB)

(73) Assignee: INNOVIA FILMS LIMITED, Wigton, Cumbria (GB)

( * ) Notice: Subject to any disclaimer, the term of this patent is extended or adjusted under 35 U.S.C. 154(b) by 1230 days.

(21) Appl. No.: 11/995,292

(22) PCT Filed: Jul. 14, 2006

(86) PCT No.: PCT/GB2006/050206

§ 371 (c)(1),
(2), (4) Date: Jun. 3, 2008

(87) PCT Pub. No.: WO2007/012892

PCT Pub. Date: Feb. 1, 2007

(65) Prior Publication Data

US 2009/0001143 A1 Jan. 1, 2009

(30) Foreign Application Priority Data

Jul. 26, 2005 (GB) ..... 0515335.8

(51) Int. Cl.
*B65D 75/58* (2006.01)

(52) U.S. Cl.
CPC ..... *B65D 75/5827* (2013.01)

(58) Field of Classification Search
USPC ..... 206/497, 449, 484; 229/87.05, 229/924–926, 103.2, 203, 207, 87.01, 240, 229/235–236, 241; 383/207–209
See application file for complete search history.

(56) References Cited

U.S. PATENT DOCUMENTS

| | | | | |
|---|---|---|---|---|
| 2,322,594 | A * | 6/1943 | Russell | 229/203 |
| 2,833,404 | A * | 5/1958 | Jacobs et al. | 229/241 |
| 3,263,807 | A * | 8/1966 | Fingerhut | 229/238 |
| 3,265,287 | A * | 8/1966 | Hovland | 206/264 |
| 3,379,364 | A | 4/1968 | Pilger | |

(Continued)

FOREIGN PATENT DOCUMENTS

| | | |
|---|---|---|
| CH | 368417 A | 3/1963 |
| EP | 0627362 A1 | 12/1994 |

(Continued)

OTHER PUBLICATIONS

International Search Report, International Preliminary Report on Patentability and Written Opinion, International Patent Application No. PCT/GB2006/050206, filed Jul. 14, 2006.

*Primary Examiner* — Anthony Stashick
*Assistant Examiner* — Robert Poon
(74) *Attorney, Agent, or Firm* — Ping Wang; Andrews Kurth LLP

(57) ABSTRACT

A ream wrap package formed by wrapping a sheet of polymeric film around a stack of paper, the sheet having at least one line of weakness formed therein, to form a rectangular tube with sides overlapping, sealing one side to the other to form a girth seal, closing the tube at each end to form an envelope seal with tucked in ends and overlapping flaps, at least one of which is trapezoidal, so that in the formed package there is at least one line of weakness extending along the whole length of a surface of the package outside the girth seal, positioned so that it terminates at each end of the package within a region of the transverse direction defined by that portion of the overlapping flaps where there are only two layers of overlapping film.

10 Claims, 8 Drawing Sheets

(56) References Cited

U.S. PATENT DOCUMENTS

Figure 1:
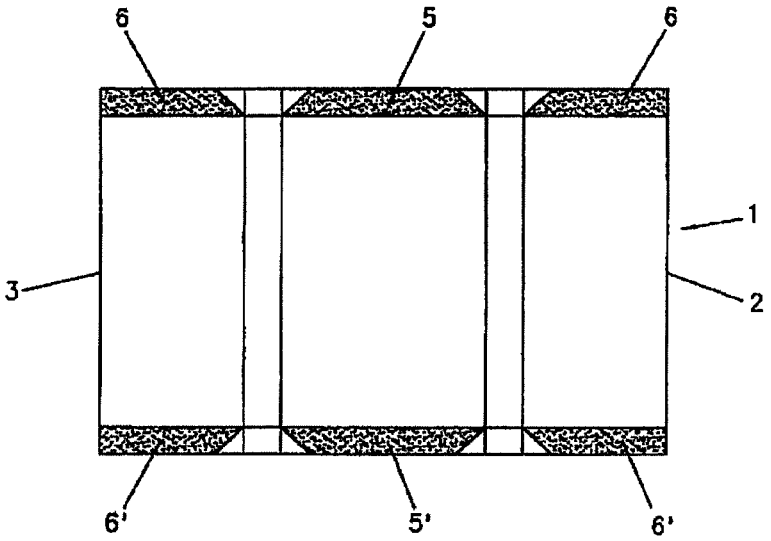
FIG. 1 (PRIOR ART)

| | | | | | |
|---|---|---|---|---|---|
| 3,684,086 | A | * | 8/1972 | Harrison | 206/449 |
| 3,750,361 | A | | 8/1973 | Stevens | |
| 3,909,582 | A | | 9/1975 | Bowen | |
| 5,001,325 | A | | 3/1991 | Huizinga | |
| 5,010,231 | A | | 4/1991 | Huizinga | |
| 5,067,612 | A | * | 11/1991 | Tsuchiya et al. | 206/497 |
| 5,072,572 | A | | 12/1991 | Meives et al. | |
| 5,158,499 | A | * | 10/1992 | Guckenberger | 206/524.2 |
| 5,380,094 | A | * | 1/1995 | Schmidt et al. | 383/209 |
| 5,630,308 | A | | 5/1997 | Guckenberger | |
| 6,006,907 | A | | 12/1999 | Sato et al. | |
| 6,363,691 | B1 | * | 4/2002 | Flaherty | 53/412 |
| 2005/0006265 | A1 | * | 1/2005 | Anderson et al. | 206/449 |
| 2005/0050851 | A1 | | 3/2005 | Osgood | |
| 2006/0027637 | A1 | | 2/2006 | Conrad et al. | |

FOREIGN PATENT DOCUMENTS

| | | | | | |
|---|---|---|---|---|---|
| GB | 458375 | | | 12/1936 | |
| GB | 2156303 | | * | 10/1985 | 229/87.05 |
| GB | 2289879 | A | | 12/1995 | |
| WO | 01/15994 | A1 | | 3/2001 | |
| WO | 01/94098 | A1 | | 12/2001 | |
| WO | 02/053473 | A1 | | 7/2002 | |

* cited by examiner

EASY OPEN REAM WRAP

FIELD

This invention relates to an easy open sealed ream wrap package that has been wrapped in a sheet of polymeric film.

DESCRIPTION

Reams of cut paper for copy machines, computers, printers, and other applications are most commonly packaged for shipping, storage, and retail sale in ream wrappers made of various wrap materials. These wrap materials traditionally have been coated paper or plastic film. The wrap materials protect the wrapped paper product from physical damage and moisture pickup during shipping and storage. The wrap materials also protect the wrapped product from physical damage during repeated handling and stocking on retail shelves.

A major market area is the distribution of reams of paper as wrapped reams for sale in individual packages containing e.g. stacks of 500 sheets. Such distribution of reams of paper has placed increasing demands on the wrapper due to more frequent handling of the individual reams. Increased handling of the reams has resulted in more reams breaking open, damaging the wrapped paper product by allowing it to pick up moisture, tear, or get minor curl—physical damage that ultimately results in jams in the end-user's printer or copy machine. However the resultant ability of a package to avoid damage arising from handling means that the packaged product is more difficult to open.

The mechanical strength of seal seams when reams are wrapped in polyolefin films, in particular biaxially oriented polypropylene films, is often higher than that of the film itself, and therefore when a sealed pack is opened it is not only the seal seam which is broken apart. Typically, a tear propagates in an uncontrolled manner through the entire film upon opening. It is also difficult to find any way to undo the package other than by pulling at the envelope seal at one or other of the ends of the package.

There is a need to provide means for opening ream wrapped packages of paper that will enable both neat and easy opening.

Stacks of e.g. A4 size 80 gsm paper will have a length of about 300 mm, a width of about 210 mm and a depth of about 50 mm. Such a stack can be wrapped in a sheet of polymeric film having a heat sealable coating on both its outer and inner surfaces. In order to form a wrap around a stack of 500 sheets of A4 paper, the sheet used will have to be about 570 by 390 mm.

Machines that can be used in wrapping reams of paper are described in e.g. U.S. Pat. No. 3,750,361 and U.S. Pat. No. 5,072,572 and their specifications are incorporated herein for reference.

In such machines, a web of polymeric film is fed to a severing station where a length of film is cut off to form a sheet of sufficient size to be used as a wrapper around a stack of paper. The stack of paper is then placed on the sheet and the sheet is then folded over the top of the stack to over lap on itself and form a rectangular tube along the length of the stack and overlapping it at each end. Heat is then applied to form an overlapped girth seal along the sheet where the sheet has been coated with a heat sealable coating or a hot melt glue system may be used in forming the seal. Each end of the tube is then tucked in and folded to form a so-called envelope seal with two overlapping trapezoidal shaped flaps. Heat is then applied to form a seal at each end of the wrapped stack where the sheet has been coated with a heat sealable coating to seal the two flaps at each end to one another or the flaps may be sealed using a hot melt glue system.

It is known to provide lines of weakness in package wrappers to make them easy to open.

Such arrangements are disclosed e.g. in U.S. Pat. No. 3,379,364 and in a co-pending application of the present applicant published as US 2005/0050851. However the arrangements that are disclosed are all designed to open packages across their width, and are designed primarily for removing an overwrap from around an already packaged article such as cigarettes in packets or cartons.

EP 627362 discloses an arrangement without lines of weakness for providing easy to open packages of relatively small articles such as magnetic tape cassettes and video cassettes. In one example (see FIG. 14), this is done by providing weakly bonded regions along a girth seal and means to initiate a split along the weakly bonded portion.

GB 458375 discloses an arrangement where a wrapping blank is used which has a box pleat provided along the whole length of the blank. The wrapper is folded in to a U-shape about the article to be enclosed and the side folds of the wrapper are then formed and secured. The end of the package is closed by end folds and end flaps. The outer end fold has slits formed adjacent to the pleat and the package can be opened by initiating tearing at the slits so that the tear propagates along each side of the pleat.

The problem of providing easy opening arrangements for reams of papers wrapped in polymeric films is one of providing an arrangement which does not interfere with the need to maintain the structural integrity and sealed condition of the package during handling while providing a simple and economic solution that is easy to use with existing ream wrap packaging machines.

We have now found that this can be done by the careful positioning of at least one line of weakness along the length of the sheet used to wrap the paper.

Our invention is based on the realisation that it is essential to select the position for any lines of weakness on the sheet so that when the wrapped package is formed the line or lines are positioned along the length of a region of the sheet so that when the sheet is wrapped around the stack of paper, the lines extend into the flaps at each end of the package where the formation of the envelope seals results in an overlapping area formed from two layers of film and not where five layers of film overlap.

According to the invention there is provided a method of forming a package which is an easy to open wrapped ream of paper formed by wrapping a sheet of polymeric film around a stack of paper, the sheet having been severed from a web of polymeric film having at least one line of weakness formed therein in the machine direction (MD) and within a region of the transverse direction (TD) the package being formed by wrapping the sheet around the stack of paper to form a rectangular tube with cut sides overlapping, sealing one side to the other to form a girth seal, closing the tube at each end to form an envelope seal with tucked in ends and overlapping flaps, at least one of which is trapezoidal so that in the formed package there is at least one line of weakness extending along the whole length of a surface of the package outside the girth seal, the line of weakness being positioned so that it terminates at each end of the package within a region of the TD defined by that portion of the overlapping flaps where there are only two layers of overlapping film.

Preferably, both overlapping flaps are trapezoidal, which will be the case when the tube ends are tucked in below both flaps. However, if one flap is tucked in first it will be a rectangular flap, and only once the remaining tube ends are then tucked in will the final overlapping flap be trapezoidal.

Our invention further includes a method of forming a package in which at least one line of weakness is provided on one surface of the package terminating at the ends of the outer flaps and extending along that surface of the package, and at least one further line is provided along the other surface of the package and extending to the end of each flap of the envelope seal formed by folding in that surface, any line being within a region defined by that portion of the overlapping flaps where there are only two layers of film.

The lines can be arranged on both surfaces so that any line of weakness on one surface where it extends into the flaps on that surface is aligned with a line as it extends into the flaps on the other surface.

Our invention is also directed to a method of forming an easy to open wrapped ream of paper that is opened by causing the package to open along lines of weakness, in which a web of polymeric film having at least two pairs of lines of weakness formed thereon in the MD is severed to form sheets and a package is formed by wrapping a sheet around the paper to form a rectangular tube with the cut sides overlapping, sealing the film within the overlap, and wrapping the ends of the tube about the paper so as to form a sealed package with an envelope seal formed from each end of the tube with tucked in ends and overlying flaps, the pairs of lines of weakness being positioned so that one pair of lines extends along a surface of the package and to the outer end of each flap formed by folding in that surface, the lines extending to the end of each flap and avoiding the tucked in ends of the envelope seal, the other pair of lines extending along the other surface of the package and to the outer end of each flap formed by folding in that surface, the lines extending to the outer end each flap and avoiding the tucked in ends of the envelope seal, the pairs of lines overlapping each other where the respective flaps are sealed to one another at each envelope seal.

Pairs of lines when provided on each surface are preferably arranged so as to be aligned when the respective flaps are sealed to each other at each envelope seal in forming the ream wrap package.

The present invention also includes a ream of paper wrapped in a sheet of polymeric film, the sheet used to wrap the film having one or more lines of weakness arranged along the machine direction of the film positioned so that when the wrapped ream is flexed about a longitudinal axis, the film parts along the one or more lines of weakness and is opened in a controlled manner.

According to the present invention there is provided a paper stack wrapped in a polymeric film wrapper, the wrapper enclosing the paper stack in a manner to provide overlapped sealing regions of the wrapper, the polymeric film wrapper having at least one line of weakness formed therein, the at least one line of weakness being positioned on the wrapper such that the degree of overlap of the polymeric wrapper in the region of the at least one line of weakness is not more than two overlapped film layers.

Means may also be provided to enable the package to be opened by initiating tearing along the lines of weakness.

Such means can include a tab formed in or adhered to the wrapped sheet.

In the case of a package formed from a sheet of film provided with a heat sealable coating, the means to initiate tearing can be provided by an area within or about the pairs of lines at the outer end of one or both pairs of flaps which is printed or overlacquered so that when the flaps are sealed together, the printed or overlacquered area forms a weaker part of the envelope seal.

Alternatively a notch or slit is provided at one or both outer flaps where a line of weakness terminates.

The printed area can also be used to provide a mark to indicate an opening direction.

Lines of weakness can be made by any suitable methods for example by mechanical scoring (e.g. with a controlled blade or roller to applies pressure to the film surface), by cut or scored perforations, by non contact means such as laser or other radiation to ablate and/or burn off a thickness of film (e.g. as 5 described in U.S. Pat. No. 3,909,582; U.S. Pat. No. 5,630,308 (both American Can) or U.S. Pat. No. 5,001,325 and U.S. Pat. No. 5,010,231 (both LPF)); by use of a laser to scramble orientation along a line on the oriented film without ablating the film surface (as described in the applicant's co-pending application PCT/EP02100075); and/or by the methods described in WO 01/15594 (Hoechst) or WO 01/94098 (University of Warwick).

The lines of weakness can be formed before the sheets of film to be used in wrapping a ream of paper are severed from a web or roll of the film. Methods include:

(a) As a web is rolled up from the line on which the film was produced from a polymeric material.

(b) During printing of a web.

(c) As a web is being fed to the packaging machine.

The term polymeric films is used herein to refer one or more of any of the following: polymeric materials: synthetic paper, films made from organic polymers, preferably biopolymers, more preferably films made from one or more suitable carbohydrates; polysaccharides (such as starch, cellulose, glycogen, hemi-cellulose, chitin, fructan inulin; lignin and/or pectic substances); gums; proteins, optionally cereal, vegetable and/or animal proteins (such as gluten [e.g. from wheat], whey protein, and/or gelatin); colloids (such as hydro-colloids, for example natural hydrocolloids, e.g. gums); polylactic, polygalactic and/or cellulosic films (e.g. microbial and/or regenerated cellulose film)]; thermoplastic films; polymeric films (for example films comprising: polyolefins [e.g. polypropylene and/or polyethylene] polyurethanes, polyvinylhalides [e.g. PVC], polyesters [e.g. polyethylene terephthalate—PET], polyamides [e.g. nylons] and/or non-hydrocarbon polymers); and/or multilayer and/or composite sheets formed by any suitable combinations and/or mixtures of thereof. The substrate may also be paper.

Preferred films for use in the present invention may be produced from a variety of synthetic polymers, for example may be polyolefin based films, e.g. polyethylene based, polypropylene based or made from polystyrene, or they may be polyester based films. Furthermore, films of the present invention may be in the form of monolayers of a particular polymer, although preferred films comprise two or more layers which can be formed by coextrusion and/or by laminating.

Biaxially oriented polypropylene (BOPP) films are preferred for producing films to be cut into sheets for use in the methods in accordance with the present invention. It is more preferred that the BOPP films have substantially balanced physical properties, for example as can be produced using substantially equal machine direction and transverse direction stretch ratios. Although sequential stretching can be used, in which heated rollers effect stretching of the film in the machine direction and a stenter oven is thereafter used to effect stretching in the transverse direction, it is generally preferred to use biaxially oriented films which have been produced by simultaneous stretching, for example using the so-called double bubble process or a simultaneous draw stenter. The machine direction and transverse direction stretch ratios are preferably in the range of from 4:1 to 10:1, and more preferably from 6:1 to 8:1.

The films used in forming the wrappers can be of a variety of thicknesses according to the requirements of the packages which are to be produced. For example they can be from about 30 to about 160 microns thick. Clear BOPP films when used for the ream wrapping of paper are usually used at thicknesses between 50 and 60 microns.

The tear line(s) should exhibit properties (e.g. a degree of weakening therealong) which are sufficient to enable a tear once started to propagate substantially along the line(s) in which it has started without substantial deviation therefrom. Insufficient tear susceptibility will make it difficult if not impossible to start a tear therealong. However excessive tear susceptibility (e.g. too much weakening) could result in unwanted opening of the packages during normal handling. As will be appreciated by those skilled in the art, different methods of achieving tear susceptibility of the films can result in different tearability.

The sheets used to wrap the reams of paper should preferably be provided with heat sealable coatings such as an acrylic coating. Hot melt glue systems can also be used to seal the sheets to form the wrapped package.

The invention will now be described with reference to the accompanying drawings in which:

FIG. 1 is a plan view of a conventional sheet of polymeric film showing fold lines to indicate how the sheet is folded about a ream of paper.

Figure 1A:
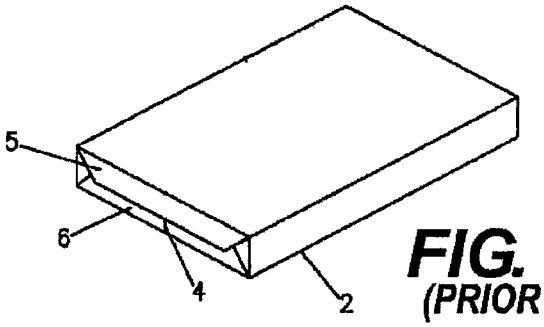
FIG. 1A (PRIOR ART)

FIG. 1*a* is a perspective view from above of a wrapped ream of paper formed by wrapping a ream of paper in the sheet of polymeric film depicted in FIG. 1.

Figure 1B:
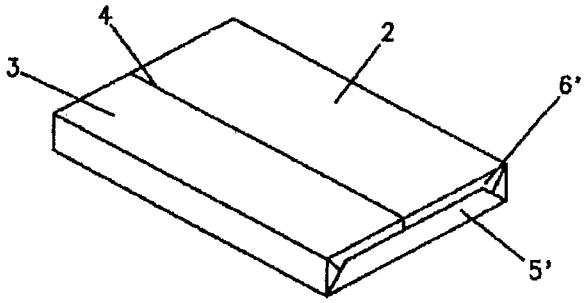
FIG. 1B (PRIOR ART)

FIG. 1*b* is a perspective view from below the wrapped ream of paper shown in FIG. 1*a*, this view showing the girth seal.

Figure 2:
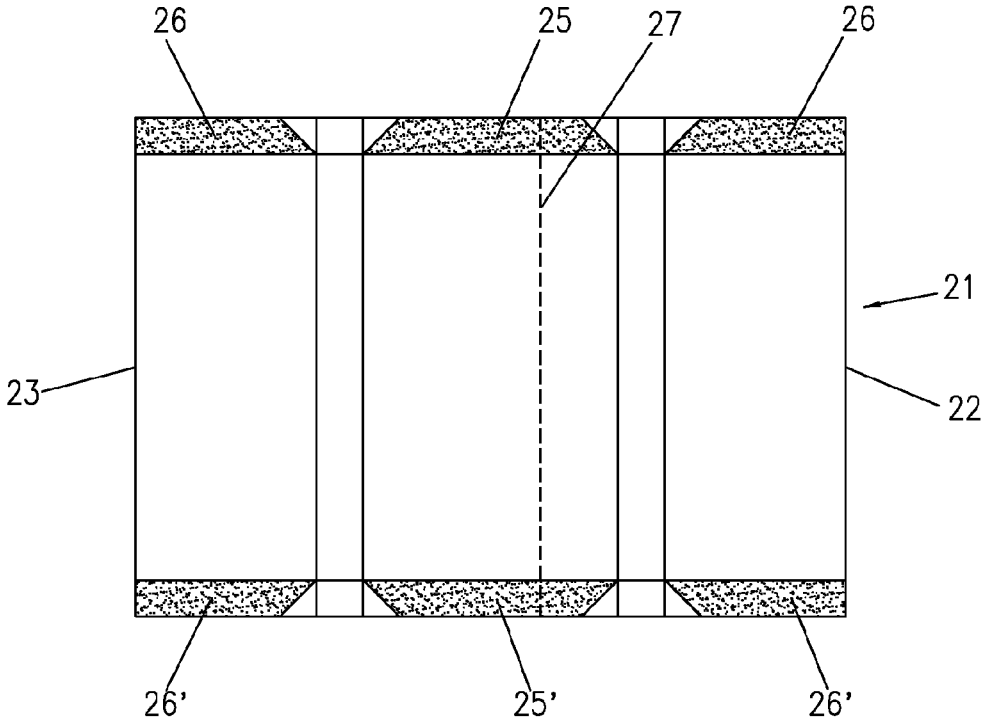

FIG. 2 is a plan view of a sheet of polymeric film in accordance with the invention showing detail as for the conventional film of FIG. 1 but also showing the position of a single line of weakness applied to the sheet relative to the position of the fold lines.

Figure 2A:
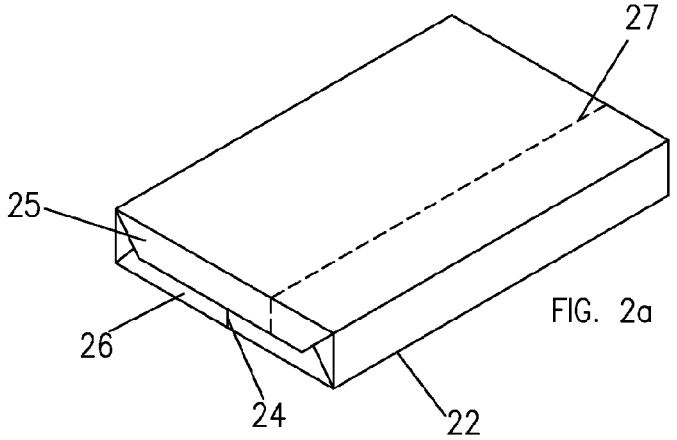

FIG. 2*a* is a perspective view from above of a wrapped ream of paper formed by wrapping a ream of paper in the sheet of polymeric film depicted in FIG. 2.

Figure 2B:
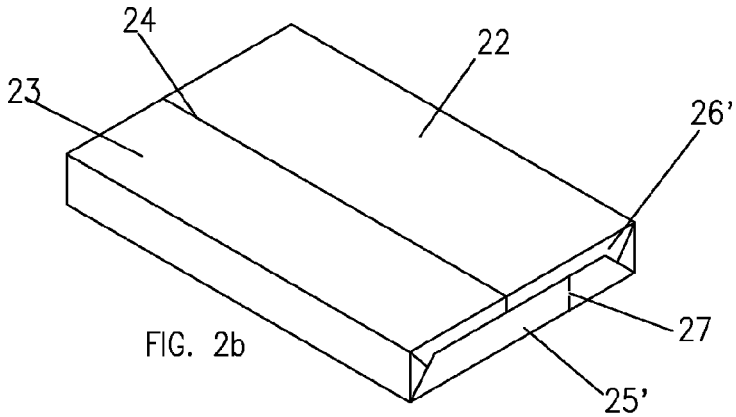

FIG. 2*b* is a perspective view from below the wrapped ream of paper shown in FIG. 2*a*, this view showing the girth seal.

Figure 3:
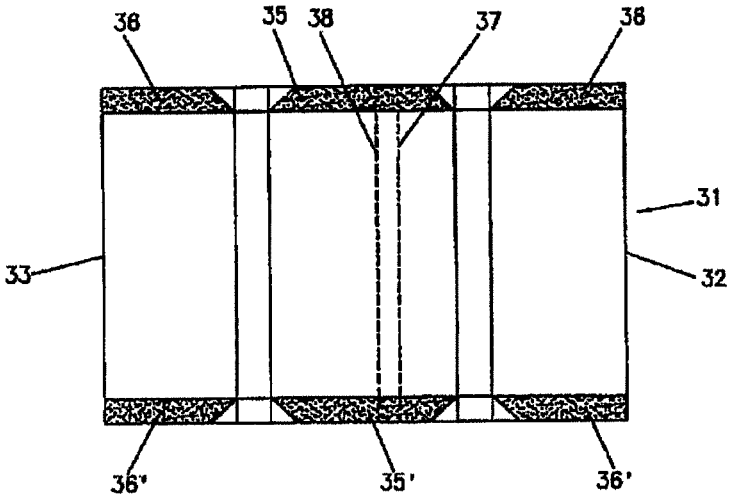

FIG. 3 is a plan view of a sheet of polymeric film in accordance with the invention showing detail as for the conventional film of FIG. 1 but also showing the position of two lines of weakness applied to the sheet relative to the position of the fold lines.

Figure 3A:
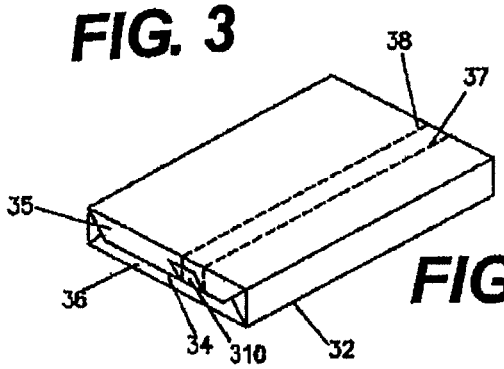

FIG. 3*a* is a perspective view from above of a wrapped ream of paper formed by wrapping a ream of paper in the sheet of polymeric film depicted in FIG. 3.

Figure 3B:
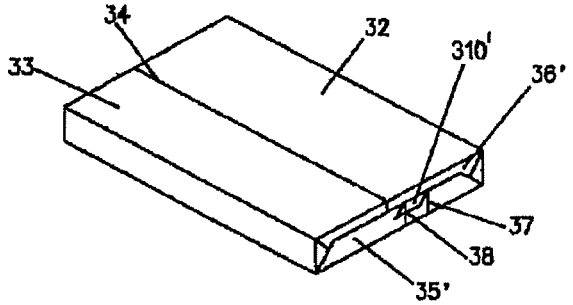

FIG. 3*b* is a perspective view from below the wrapped ream of paper shown in FIG. 3*a*, this view showing the girth seal.

Figure 4:
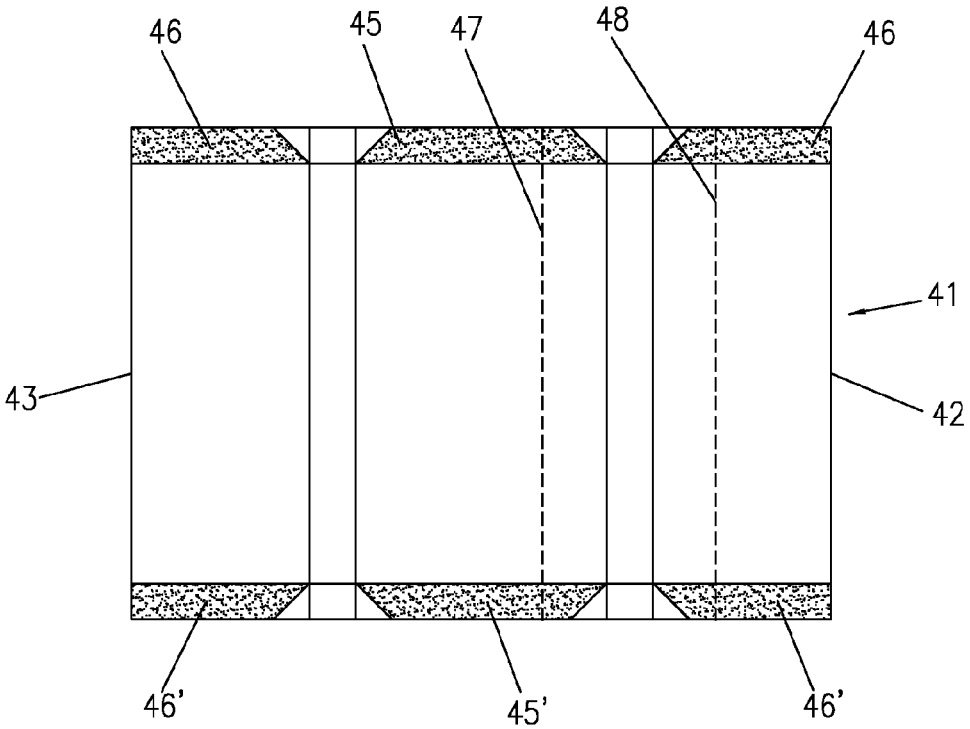

FIG. 4 is a plan view of a sheet of polymeric film in accordance with the invention showing detail as for the conventional film of FIG. 1 but also showing an alternative position of two lines of weakness applied to the sheet relative to the position of the fold lines.

Figure 4A:
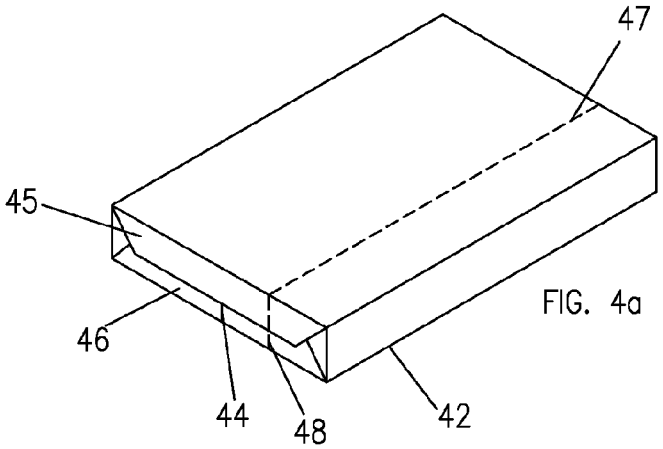

FIG. 4*a* is a perspective view from above of a wrapped ream of paper formed by wrapping a ream of paper in the sheet of polymeric film depicted in FIG. 4.

Figure 4B:
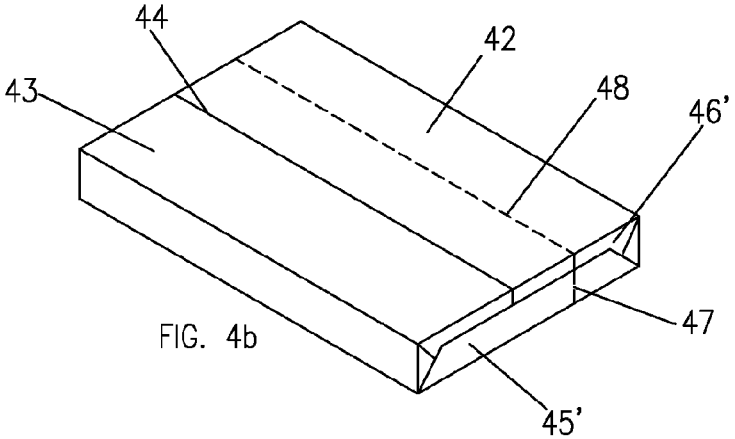

FIG. 4*b* is a perspective view from below the wrapped ream of paper shown in FIG. 4*a*, this view showing the girth seal.

Figure 5:
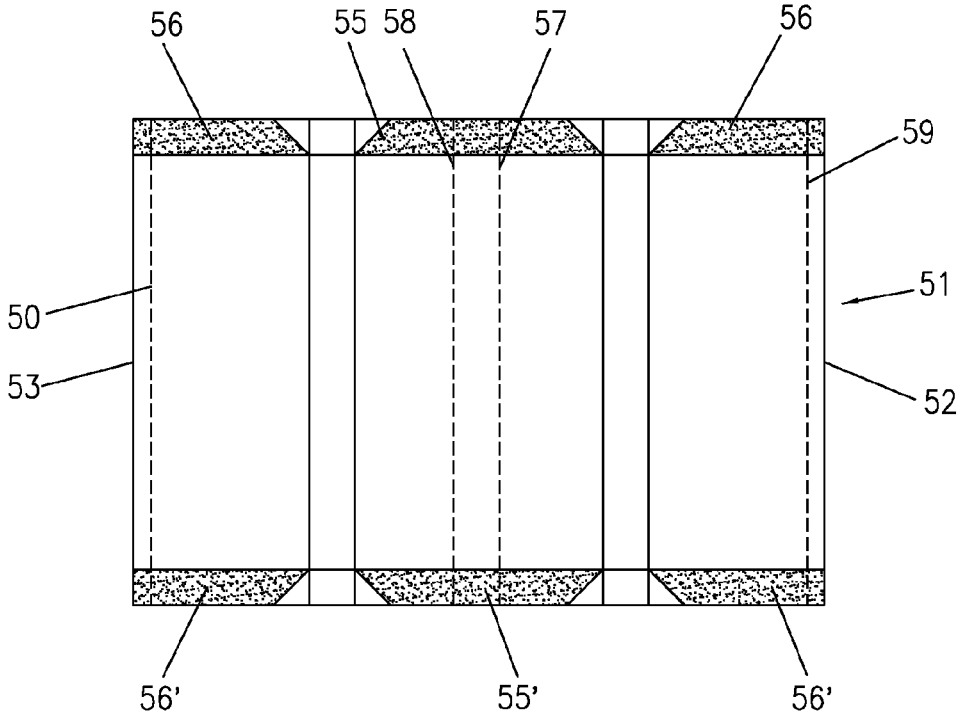

FIG. 5 is a plan view of a sheet of polymeric film in accordance with the invention showing detail as for the conventional film of FIG. 1 but also showing the position of four lines of weakness applied to the sheet relative to the position of the fold lines.

Figure 5A:
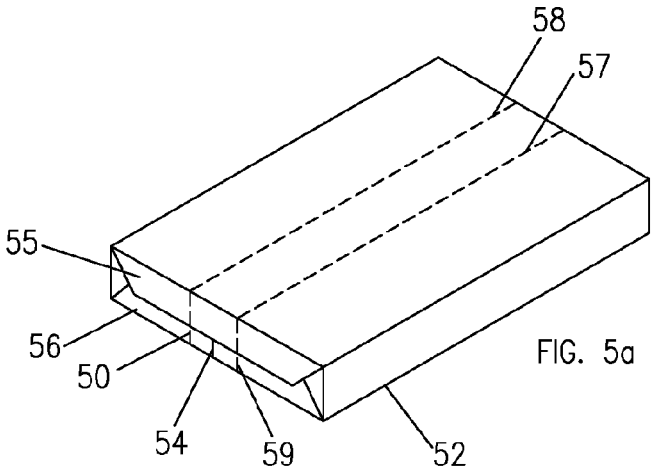

FIG. 5*a* is a perspective view from above of a wrapped ream of paper formed by wrapping a ream of paper in the sheet of polymeric film depicted in FIG. 5.

Figure 5B:
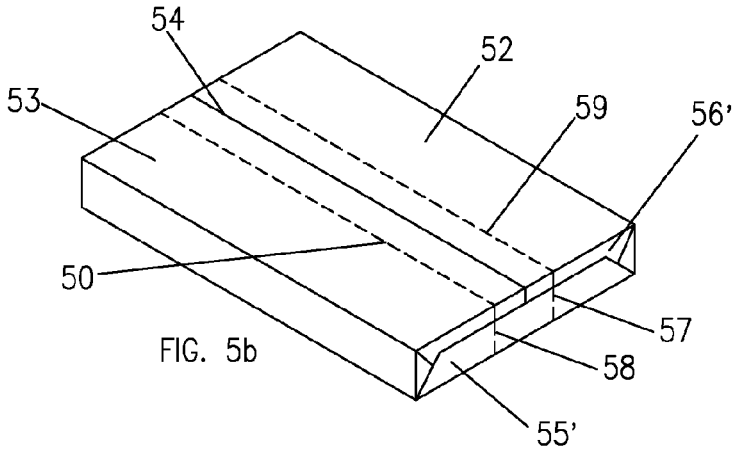

FIG. 5*b* is a perspective view from below the wrapped ream of paper shown in FIG. 5*a*, this view showing the girth seal.

Figure 6:
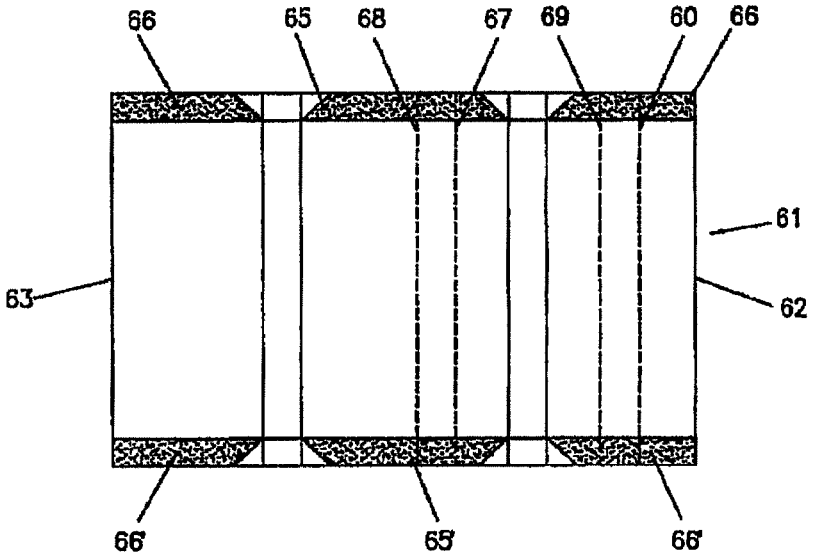

FIG. 6 is a plan view of a sheet of polymeric film in accordance with the invention showing detail as for the conventional film of FIG. 1 but also showing an alternative position of four lines of weakness applied to the sheet relative to the position of the fold lines.

Figure 6A:
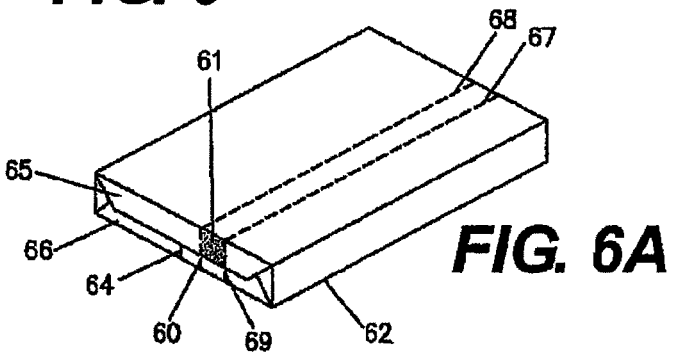

FIG. 6*a* is a perspective view from above of a wrapped ream of paper formed by wrapping a ream of paper in the sheet of polymeric film depicted in FIG. 6.

Figure 6B:
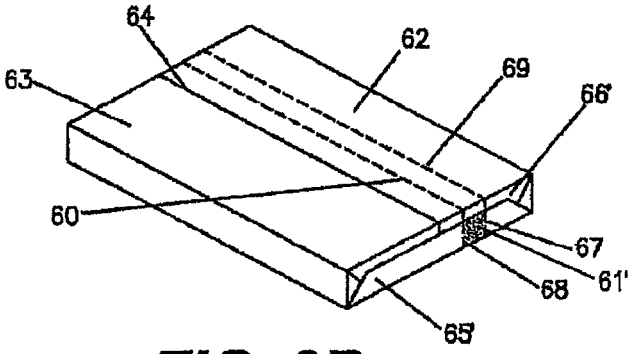

FIG. 6*b* is a perspective view from below the wrapped ream of paper shown in FIG. 6*a*, this view showing the girth seal.

Referring to FIGS. 1, 1*a* and 1*b*, sheet 1 is folded around a ream of paper by folding the sheet so that edge 2 overlaps edge 3 thus forming a rectangular tube around the ream of paper. The overlapping parts of the sheet are sealed together to form girth seal 4, shown in FIG. 1*b*. Each end of the rectangular tube is then tucked in to form an envelope seal at each end with flaps 5 and 5' overlapping the flaps formed by 6 and 6'. The shaded regions indicate the flaps. In the wrapped ream there will over most of the shaded region be only two layers of film at the envelope seals. However, there will be a region of overlap at the girth seal where three film layers overlap in the final envelope seal. Towards the edges of the envelope seals there may at some places be five overlapping film layers.

Alternatively, but with substantially the same result regarding the region of the seals comprising only two layers of film, after formation of girth seal 4 flaps 6 and 6' may be folded in as rectangular flaps and then each end of the tube is tucked in to form the envelope seal. Trapezoidal flaps 5 and 5' are then folded down over the tucked in ends and the rectangular flap.

Referring to FIGS. 2, 2*a* and 2*b*, a single line of weakness 27 is formed along the surface of the sheet and positioned so that it extends to the ends of the sheet whereby in the wrapped ream, as shown in FIGS. 2*a* and 2*b*, the line extends into region of the flaps 25 and 25' where there are only be two layers of film.

Figure 3C:
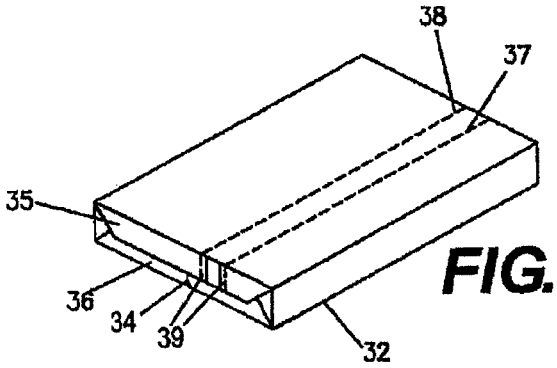
Figure 3D:
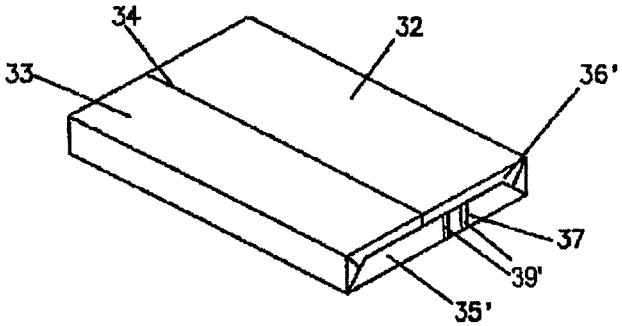

Referring to FIGS. 3, 3*a* and 3*b*, two lines of weakness 37 and 38 are formed along the surface of the sheet and positioned so that they extend to the ends of the sheet whereby in the wrapped ream, as shown in FIGS. 3*a* and 3*b*, the lines extend into region of the flaps 35 and 35' where there are only two layers of film. FIGS. 3*a* and 3*b* depict means for enabling the package to be opened by initiating tearing along the lines of weakness in the form a tab 310, 310' adhered to the wrapped sheet. FIGS. 3*c* and 3*d* depict means for enabling the package to be opened by initiating tearing along the lines of weakness in the form of slits 39, 39' provided at both outer flaps where the lines of weakness terminate.

Referring to FIGS. 4, 4*a* and 4*b*, alternative positions for the two lines of weakness 47 and 48 are shown, in which the lines are formed along the surface of the sheet and positioned so that they extend to the ends of the sheet whereby in the wrapped ream, as shown in FIGS. 4*a* and 4*b*, the lines extend into region of the flaps 35 and 35' where there are only two layers of film. In this embodiment lines 47 and 48 may be positioned substantially to co-align in the wrapped ream, as shown in FIG. 4.

Referring to FIGS. 5, 5*a* and 5*b*, four lines of weakness are shown. A pair of lines of weakness 57 and 58 are formed along the surface of the sheet as shown in FIG. 5 and positioned so that they extend to the ends of the sheet whereby in the wrapped ream as shown in FIGS. 5*a* and 5*b* the lines extend into the region of the flaps 55 and 55' where there are only two layers of film. A further pair of lines of weakness 59 and 50 are formed along the surface of the sheet as shown in FIG. 5 and positioned so that they extend to the ends of the sheet whereby in the wrapped ream as shown in FIGS. 5*a* and 5*b* the lines extend into the region of the flaps 56 and 56' where there are only be two layers of film. In the FIG. 5 embodiment the lines 59 and 50 are positioned so that they co-align with the lines 57 and 58 in the wrapped ream. These lines may alternatively be arranged so that the line 59 co-aligns with line 58 and line 50 with line 57 in the wrapped ream, or there may be little or no co-alignment in some embodiments.

Figure 6C:
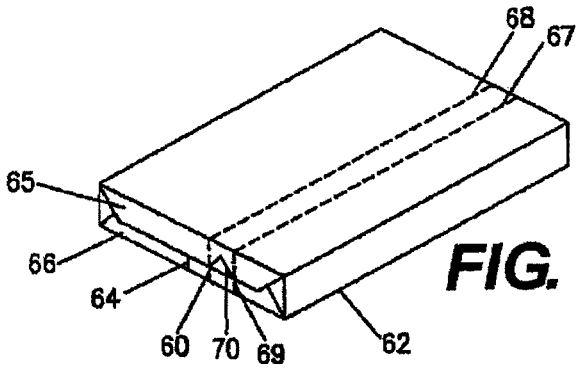
Figure 6D:
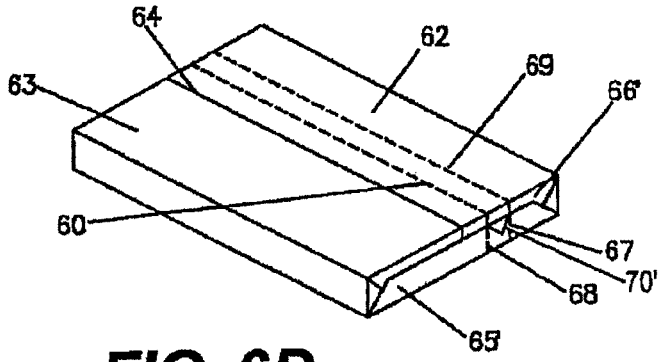

Referring to FIGS. 6, 6*a* and 6*b*, four lines of weakness are shown. A pair of lines of weakness 67 and 68 are formed along the surface of the sheet as shown in FIG. 6 and positioned so that they extend to the ends of the sheet whereby in the wrapped ream as shown in FIGS. 6*a* and 6*b* the lines extend into the region of the flaps 65 and 65' where there are only two layers of film. A further pair of lines of weakness 69 and 60 are formed along the surface of the sheet as shown in FIG. 6 and positioned so that they extend to the ends of the sheet whereby in the wrapped ream as shown in FIGS. 6*a* and 6*b* the lines extend into the region of the flaps 66 and 66' where there are only be two layers of film. In the FIG. 6 embodiment the lines 69 and 60 are positioned so that they co-align with the lines 67 and 68 in the wrapped ream. These lines may alternatively be arranged so that the line 59 co-aligns with line 58 and line 50 with line 57 in the wrapped ream, or there may be little or no co-alignment in some embodiments. FIGS. 6*a* and 6*b* depict means for enabling the package to be opened by initiating tearing along the lines of as an area (shaded) 61, 61' within the pairs of lines at the outer end of both pairs of flaps which is printed or overlacquered so that when the flaps are sealed together, the printed or overlacquered area forms a weaker part of the envelope seal. FIGS. 6*c* and 6*d* depict means for enabling the package to be opened by initiating tearing along the lines of weakness in the form of notches 70, 70' provided at both outer flaps where the lines of weakness terminate.

The invention claimed is:

1. A ream wrap package formed by a method comprising the steps of:

wrapping a sheet of polymeric film around a stack of paper to form a rectangular tube with sides overlapping, the sheet having been severed from a web of polymeric film having at least one line of weakness formed therein in the machine direction (MD) and within a region of the transverse direction (TD);

sealing one side to the other to form a girth seal; and closing the tube at each end to form an envelope seal with tucked in ends and overlapping trapezoidal flaps, so that in the formed package there is at least one line of weakness extending along the whole length of a surface of the package outside the girth seal, the line of weakness being positioned so that it terminates at each end of the package within a region of the TD defined by that portion of the overlapping flaps where there are only two layers of overlapping film, wherein at least one first line of weakness is provided on a first surface of the package terminating at the ends of the outer flaps and extending along that surface of the package, and at least one second line of weakness provided along the same surface of the package and extending to the end of each flap of the envelope seal formed by folding in that surface, wherein the first and second lines of weakness are parallel to each other and are within a region defined by that portion of the overlapping flaps where there are only two layers of film;

wherein a second surface of the package is provided with a pair of lines of weakness and wherein one line of weakness of the pair is provided towards one TD end of the film in its unwrapped condition, and the other line of weakness of the pair is provided towards the opposite TD end of the film in its unwrapped condition;

wherein the pair of lines weakness on the second surface of the package terminate at the ends of the outer flaps and extending along that surface of the package, any such pair of lines being within a region defined by that portion of the overlapping flaps where there are only two layers of film; and wherein the lines are arranged on the first and second surfaces of the package so that any first line of weakness on the first surface where it extends into the flaps on that surface co-aligns with one of the pair of lines of weakness as it extends into the flaps on the second surface, and any second line of weakness on the first surface where it extends into the flaps on that surface co-aligns with the other of the lines of weakness as it extends into the flaps on the second surface.

2. The ream wrap package according claim 1, wherein means are provided to enable the package to be opened by initiating tearing along the lines of weakness.

3. The ream wrap package according to claim 2, wherein such means comprises a tab formed in or adhered to the wrapped sheet.

4. The ream wrap package according to claim 1 formed from a sheet of film provided with a heat sealable coating.

5. The ream wrap package according to claim 4 comprising means to initiate tearing provided by an area within or about the, any or each line of weakness at the outer end of one or both pairs of flaps which is printed or overlacquered so that when the flaps are sealed together, the printed or overlacquered area forms a weaker part of the envelope seal.

6. The ream wrap package according to claim 1, wherein a notch or slit is provided at one or both outer flaps where a line of weakness terminates.

7. The ream wrap package according to claim 1, wherein the at least one line of weakness is formed before the sheet of film is severed from the web of polymeric film.

8. The ream wrap package according to claim 1, wherein the polymeric film comprises two or more polymeric layers.

9. The ream wrap package according to claim 1, wherein the polymeric film is a biaxially oriented polypropylene film.

10. The ream wrap package according to claim 1, wherein the first and second lines of weakness comprise perforations in the film.

* * * * *